US011628113B2

(12) United States Patent
Alverson et al.

(10) Patent No.: US 11,628,113 B2
(45) Date of Patent: Apr. 18, 2023

(54) INFANT STABILIZER

(71) Applicant: SmölTap, Inc., Providence, RI (US)

(72) Inventors: Brian Alverson, Barrington, RI (US); Ravi Stephen D'Cruz, Seattle, WA (US); Daniel Joseph Nelsen, Central Falls, RI (US)

(73) Assignee: SmölTap, Inc., Providence, RI (US)

( * ) Notice: Subject to any disclaimer, the term of this patent is extended or adjusted under 35 U.S.C. 154(b) by 14 days.

(21) Appl. No.: 17/070,024

(22) Filed: Oct. 14, 2020

(65) Prior Publication Data

US 2021/0106482 A1 Apr. 15, 2021

Related U.S. Application Data

(60) Provisional application No. 62/915,305, filed on Oct. 15, 2019.

(51) Int. Cl.
*A61G 13/00* (2006.01)
*A61G 13/12* (2006.01)

(52) U.S. Cl.
CPC ..... *A61G 13/0054* (2016.11); *A61G 13/121* (2013.01); *A61G 13/122* (2013.01); *A61G 2200/14* (2013.01); *A61G 2200/325* (2013.01)

(58) Field of Classification Search
CPC ..... A61G 13/0054; A61G 13/121; A61G 13/122; A61G 2200/325; A61G 15/007
See application file for complete search history.

(56) References Cited

U.S. PATENT DOCUMENTS

| | | | | |
|---|---|---|---|---|
| 4,207,879 | A * | 6/1980 | Safadago | A61G 13/009 482/142 |
| 4,291,917 | A * | 9/1981 | Hawks | A61G 5/1091 297/452.64 |
| 6,273,865 | B1 * | 8/2001 | Perez | A61G 15/007 601/46 |
| 9,056,041 | B2 * | 6/2015 | Cho | A61F 5/04 |
| 2015/0075539 | A1 * | 3/2015 | Serdyuk | A61G 5/10 128/845 |

OTHER PUBLICATIONS

Williams, Michael A. MD, Spinal catheter insertion via seated lumbar puncture using a massage chair, American Academy of Neurology, p. 1859-1860 (Year: 2002).*
Robert A. Pretlow, III, The LP Seat: A device for positioning and restraining infants and children for lumbar puncture, vol. 59 (1) pp. 128-129 (Year: 1977).*

(Continued)

*Primary Examiner* — David R Hare
*Assistant Examiner* — Adam C Ortiz
(74) *Attorney, Agent, or Firm* — David R. Josephs

(57) ABSTRACT

The invention relates to an infant positioning device for stabilizing and maintaining an infant in a fixed position for a lumbar puncture procedure. The device consists of a frame with openings for the infant's face and abdomen to support the infant in the proper position for the procedure and allow for unimpeded ventilation, a component of the frame to secure and stabilize the infant within the frame to prevent movement during the procedure, and an attachment stand to the frame that allows the frame to be free-standing.

16 Claims, 8 Drawing Sheets

(56) References Cited

OTHER PUBLICATIONS

Pretlow, Robert A, "The LP Seat: A Device for Positioning and Restraining Infants and Children for Lumbar Puncture," Pediatrics, Official Journal of the American Academy of Pediatrics, 1977, https://pediatrics.aapublications.org/content/59/1/128, Accessed Sep. 15, 2020.

Boettner, Angela, University of Nebraska, "The Effectiveness of a Pediatric Lumbar Puncture Restraint Device (SNOWBOARD)," ClinicalTrials.gov, U.S. National Library of Medicine, URL: https://clinicaltrials.gov/ct2/show/study/NCT00980070?cond=positioning+device&draw=2&rank=5, Accessed Sep. 15, 2020.

Infant Positioning, "Table Allows Doctors to Perform Complex Procedures with More Confidence," SNOW, Marcus MD, UNEMED—Tech transfer for Nebraska, URL: https://unemed.com/product/infant-positioning#prettyPhoto, Accessed Sep. 15, 2020.

* cited by examiner

INFANT STABILIZER

CROSS REFERENCE TO RELATED APPLICATION

This application is related to, and claims benefit from, earlier filed U.S. Provisional Application No. 62/915,305, filed Oct. 15, 2019, entitled "INFANT STABILIZER," incorporated herein its entirety.

BACKGROUND OF THE INVENTION

For any febrile infant under 60 days of age, it is standard of care to perform a lumbar puncture (also known as a spinal tap) to sample cerebrospinal fluid (CSF) in certain cases including suspected cases of meningitis or depending on the age of the infant, even a fever. The success of this procedure is highly dependent on the individual holding the baby, rather than the one performing the procedure. As febrile infants can often move unexpectantly, such movements can cause the lumbar puncture to be unsuccessful, through no fault of the individual holding the baby or the one performing the procedure. These unexpected infant movements can lead to common problems, such as blood contamination of CSF specimens and the inability to obtain CSF, both of which interfere with the detection and diagnosis of meningitis, a potentially fatal infection that affects approximately 0.4% of febrile infants under 60 days of age.

It is known that delaying the administration of antibiotics is tightly associated with brain damage and death in infants with meningitis. As a result, a provider may administer antibiotics in the case of an ill-appealing infant even if a CSF sample is unable to be obtained. However, this poses an issue because premature antibiotic administration renders any subsequent CSF samples sterile, rendering the care team unable to select the most appropriate antibiotics. Additionally, in an infant who does not have meningitis, a blood-contaminated CSF sample may be uninterpretable, resulting in the unnecessary administration of 2-3 weeks of intravenous antibiotics in the inpatient setting. Therefore, because of the inability to obtain an adequate CSF sample, infants commonly receive unnecessary antibiotics and have a prolonged hospitalization, at great cost to the medical system. Currently, a successful spinal tap is generally considered to be "hold dependent," and thus, approximately 25% of infant taps are unsuccessful or contaminated with blood.

Prior art solutions are varied and fail to provide for the safety of the infant in reliable manner. They often involve a number of discrete pieces which must be secured to a fixed table. For example, one such device includes at least three discrete pieces which attempts to secure the infant in a lateral recumbent position. The child is placed on a cloth covered board and the securement pieces are fixed using a hook and loop fastener. If the child is scared and in pain, they are likely able to exceed the needed forces to dislodge the discrete pieces that are there to secure them which can result in injury to the child or invalid results. Such prior art devices, and other alternatives, are cumbersome and can create undue stress for the infant.

As such, there is a need in the art for a device that allows for standardized and effective performance of lumbar puncture procedures.

SUMMARY OF THE INVENTION

The present invention preserves the advantages of prior art infant stabilizers while additionally providing new advantages not found in currently available infant stabilizers and overcomes many disadvantages of such currently available infant stabilizers.

The present invention provides an infant stabilizer device that can better stabilize an infant and that does not suffer from the disadvantages in the prior art. The present invention provides an infant stabilizer that can better secure an infant in the proper "crunch" position to better prevent movement during a procedure. Moreover, the present invention enables a free-standing stabilizer that allows for unimpeded ventilation to allow the infant to breath freely. Additionally, or alternatively, the present disclosure provides for an adjustable stabilizer that can be sized for infants of various sizes.

Advantageously, the instant devices can improve the rates of non-traumatic lumber punctures and maintain the infant's ability to breath comfortably—while maintaining the infant in a secure upright position which has been shown to be better positioning for maximal width of spinal fluid column. These advantages during the procedure can lead to lower costs and shorter hospital stays.

BRIEF DESCRIPTION OF THE DRAWING FIGURES

The novel features which are characteristic of the present invention are set forth in the appended claims. However, the invention's preferred embodiments, together with further objects and attendant advantages, will be best understood by reference to the following detailed description taken in connection with the accompanying drawings in which:

DESCRIPTION OF THE INVENTION

Figure 1:
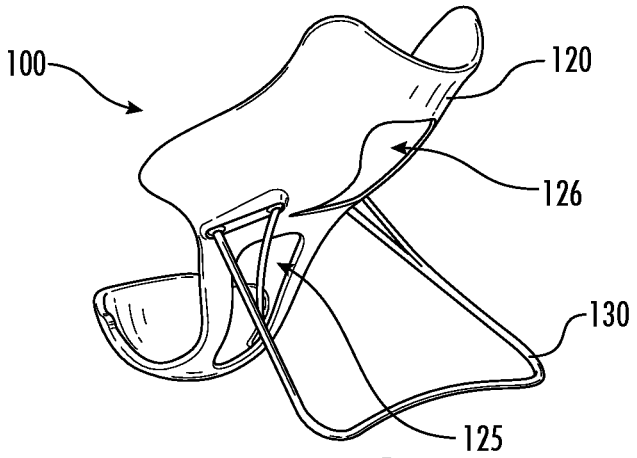
FIG. 1 is a rear three-quarters perspective view of the frame, frame openings, and stand attachment of the infant stabilizer of the present invention.
Figure 2:
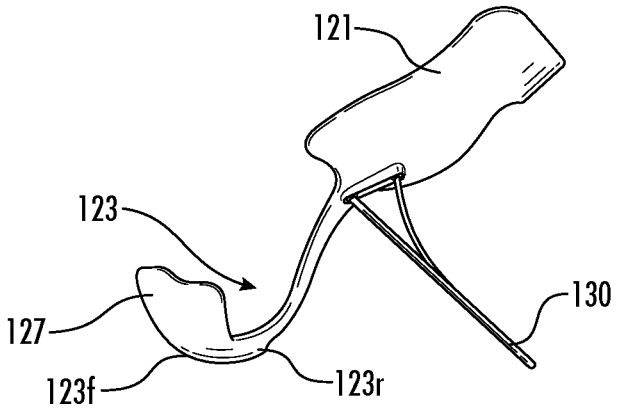
FIG. 2 is a side profile view of the frame and stand attachment of the infant stabilizer of FIG. 1.
Figure 3:
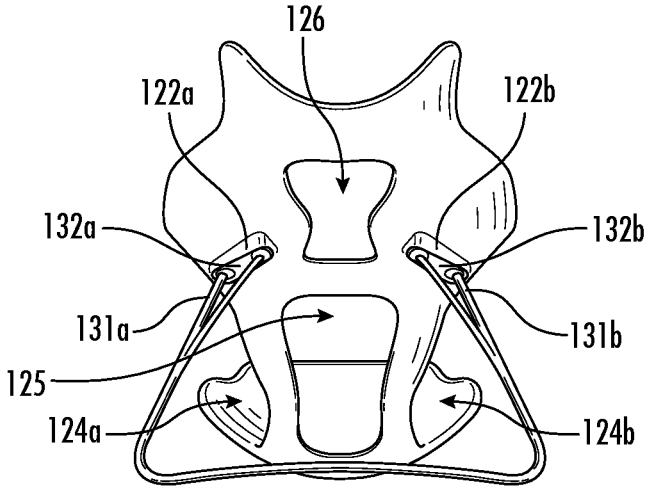
FIG. 3 is a rear perspective view of the frame, frame openings, and stand attachment of the infant stabilizer of FIG. 1.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like proximal, distal, top, bottom, up, or down are used, they are not intended to limit the systems, devices, and methods disclosed herein. A person skilled in the art will recognize that these terms are merely relative to the system and device being discussed and are not universal. Further, for ease of discussion, the present invention is discussed in connection with infants and lumbar puncture procedures, however the instant device can be used with patients of any age or size and for any number of medical, or non-medical, procedures.

The present invention provides new and novel infant stabilizer devices that can repeatably maintain an infant, or patient of any age, in the proper position during a medical procedure, such as a lumbar puncture, while permitting unimpeded ventilation and breathing for the infant.

In one exemplary embodiment, the present disclosure is directed to an infant positioning device 100 for stabilizing and maintaining an infant 110 in a fixed position for a lumbar puncture procedure. The device 100 can consist of a frame 120 with openings 125, 126 for the infant's face and abdomen to support the infant 110 in the proper position for the procedure and allow for unimpeded ventilation, to ensure that the infant can breathe properly during the procedure. Further, a component of the frame can be provided to secure and stabilize the infant within the frame to prevent movement during the procedure. Moreover, the device can include a stand attachment 130 to the frame that allows the frame to be free-standing.

In a first embodiment, as shown in FIGS. 1-5, an infant positioning stabilizer is provided. The infant positioning stabilizer 100 can stabilize and maintain an infant 110 in a fixed position during a medical procedure. As noted above, one such medical procedure is a lumbar puncture. During the lumbar puncture procedure, it is imperative that the infant 110 is secured in a fixed fashion so that they do not move. Such movements can compromise the results of the test or cause injury to the infant. In general, the device 100 includes a frame 120 for positioning the infant 110 in the appropriate position and a stand attachment 130 for allowing the frame 120 to be self-standing and to be oriented at an angle appropriate to the medical procedure being performed. The attachment stand, attachment, or stand, 130 can be mounted or otherwise connected at an appropriate angle relative to the frame 120 to enable the device 100 to stabilize and maintain the infant 110 in the appropriate position throughout the duration of a medical procedure.

The attachment stand 130 can preferably be in the form of a stand that is secured to the frame 120 by fasteners (not shown), and the like. The attachment 130 can be formed of metal, or other rigid materials, in a generally "U" shape. The ends 131*a*, 131*b* of the attachment 130, can be formed as a generally triangular shape that can serve as anchor points 132*a*, 132*b* to be inserted into slots 122*a*, 122*b* on a rear side 121*r* of the upper portion 121 of the frame 120. The attachment 130 can be angularly adjustable, relative to the frame 120, within the slots 122*a*, 122*b*, to permit the angle of the frame 120 to be adjusted for a given procedure. Additionally, or alternatively, the attachment stand 130 may be selectively angularly locked relative to the frame 120. In a further alternative the attachment stand 130 may also be integrally formed with the frame 120.

Figure 4:
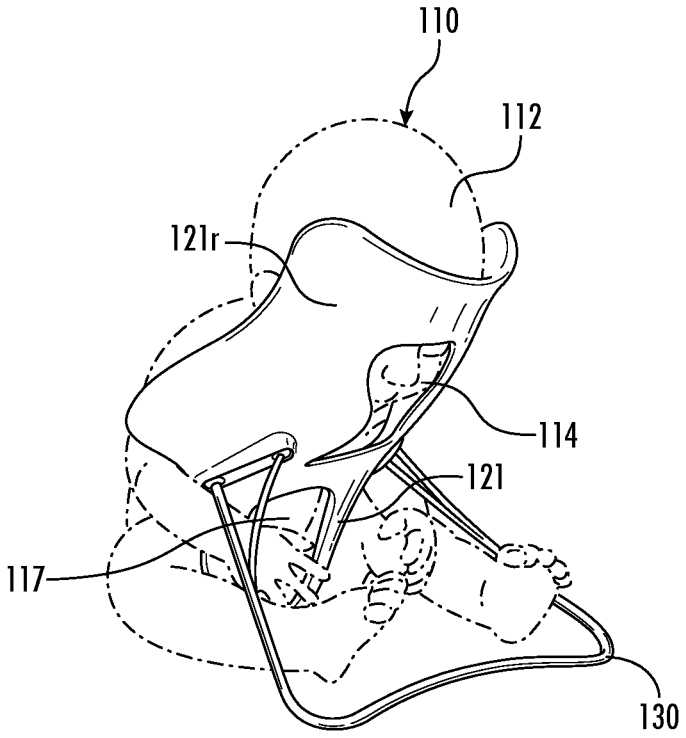
FIGS. 4 and 5 shows the infant stabilizer device of the present invention in use.

The frame 120 can, advantageously, be designed to provide both ergonomic comfort and proper positioning for the infant 110, as shown in at least FIG. 4. As can also be seen in FIGS. 1-3, the frame 120 can generally include a bottom portion 123 that has a generally bowl shape, including two leg cut outs 124*a*, 124*b* and an abdomen opening 125. Extending upward from a front 123*f* of the bottom portion can be a stop 127 that can prevent the infant 110 from sliding backward out of the bottom portion 123. Additionally, or alternatively, extending upward from a rear 123*r* of the bottom portion 123 can be the upper portion 121 of the frame 120. Similar to the bottom portion 123, the upper portion 121 can have a "U" shaped cross-section to ergonomically cradle the infant's head 112 and shoulders/torso 116 and a corresponding facial opening 126 to allow the infant's face 114 to be exposed to allow for unimpeded breathing. In the illustrated embodiment, the frame 120 is an integral assembly where the upper and bottom portions 121, 123 are formed as a single piece. The frame 120 can be formed of a variety of materials including rigid plastics, or other materials which can be sterilized. In some embodiments, the frame 120 can include padding on a front face to provide additional comfort to the infant 110 being strapped to the frame.

Figure 5:
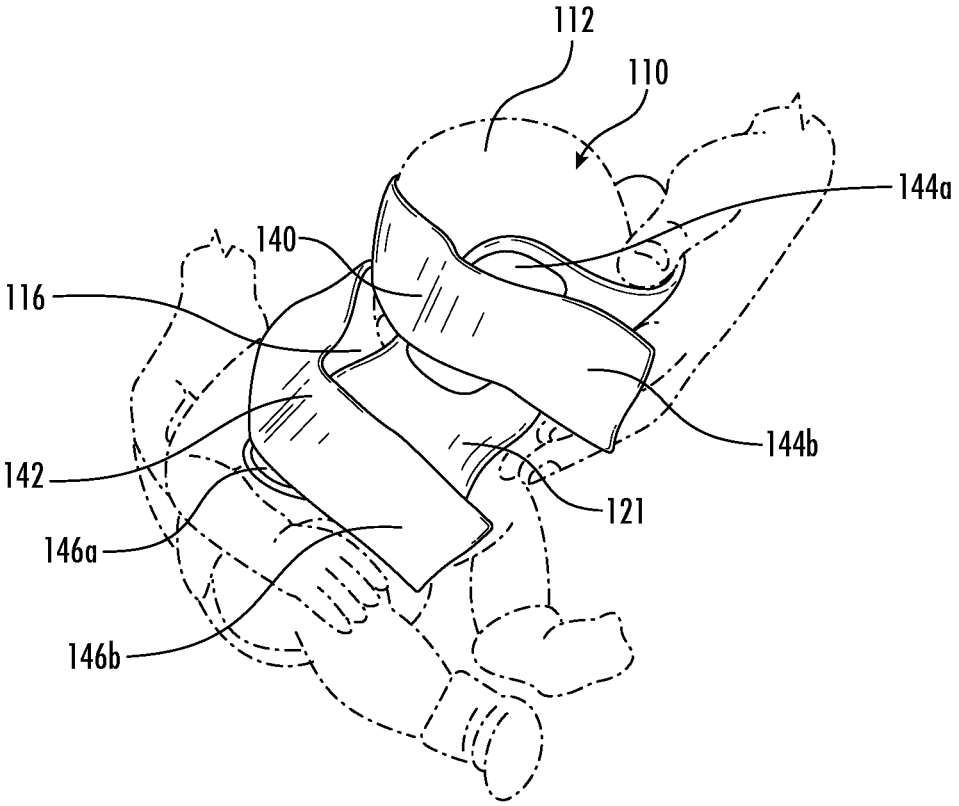

In some embodiments, as shown in FIG. 5, the device 100 may employ an upper strap 140 and a lower strap 142. The straps 140, 142 can have one side made of a soft material which can be secured for example by hook and loop fasteners 144*a*, 144*b*, 146*a*, 146*b*. The fasteners 144 *a,b*, 146 *a,b*, are placed on the rear of the upper portion 121 to allow for adjustable attachment of the straps 140, 142. As shown in FIG. 5, the upper strap 140 can be used to secure the head 112 of the infant 110 and the lower strap 142 can be used to secure the infant's torso 116. Of note, in FIG. 5, the attachment stand 130 is removed for ease of illustration purposes only.

In one exemplary method of use, as shown in FIGS. 4 and 5, the infant 110 can be placed to face forward into the frame 120 that is supported at a desired angle by the attachment stand 130. The infant 110 can be positioned so that the openings 125, 126 in the frame 120 are aligned with the face 114 and abdomen 117 to ensure the infant's face 114 and abdomen 117 are appropriately situated, as best seen in FIGS. 4 and 5. Once the infant 110 is in the desired position, as in FIG. 5, the straps 140, 142 can be secured in place. The infant 110 is thus stabilized, using the attachment(s) to the frame to ensure minimal movement of the infant's head 112 and body, or torso, 116. The frame component 120 along with the attachment stand 130 achieves the desired angle to the ground for a procedure, such as a lumbar puncture, and to ensure that the frame 120 is self-standing during the lumbar puncture.

A second embodiment of a self-standing infant stabilizer device 200 is shown in FIGS. 6-11. The second embodiment 200 provides for a larger number of adjustments for the device to accommodate a larger number of sizes of infants. In the illustrate embodiment, the frame, or static frame, 220 can include an upper and lower frame portions 221, 223 and a slide frame 250 which is a separate part that can slide relative to the frame 220. Additionally, the device 200 can include slidable straps 240*a*, 240*b*, 242*a*, 242*b* which can vertically slide relative to the slide frame 250. Thus, the device 200 can provide for added adjustments as compared to the single use size of the device 100.

The frame 220 of the device 200 can, like the device 100 above, cradle and support an infant for a variety of medical procedures, including a lumbar puncture. The infant 110 is placed on the frame 220 in similar fashion to frame 120 of the first embodiment 100 of the present invention. The frame 220 can be made of various materials include of plastics or metals that can be easily and quickly sanitized for multiple uses. The frame 220 can be a single unitary piece made from a single piece of material. The lower frame portion 223 can have a generally bowl shape including an upper backing or stop 227 extending from the front 223*f* of the device 200 to prevent the infant from sliding out. At the rear 223*r* of the frame 220, the lower frame portion 223 can have two leg cut outs 242*a*, 242*b* sized to receive the legs of the infant. The frame 220 can additionally include an abdomen opening 225 that allows for the infant to breath regularly. Extending up from above the abdomen opening can be an upper u-shaped frame 221.

Figure 8:
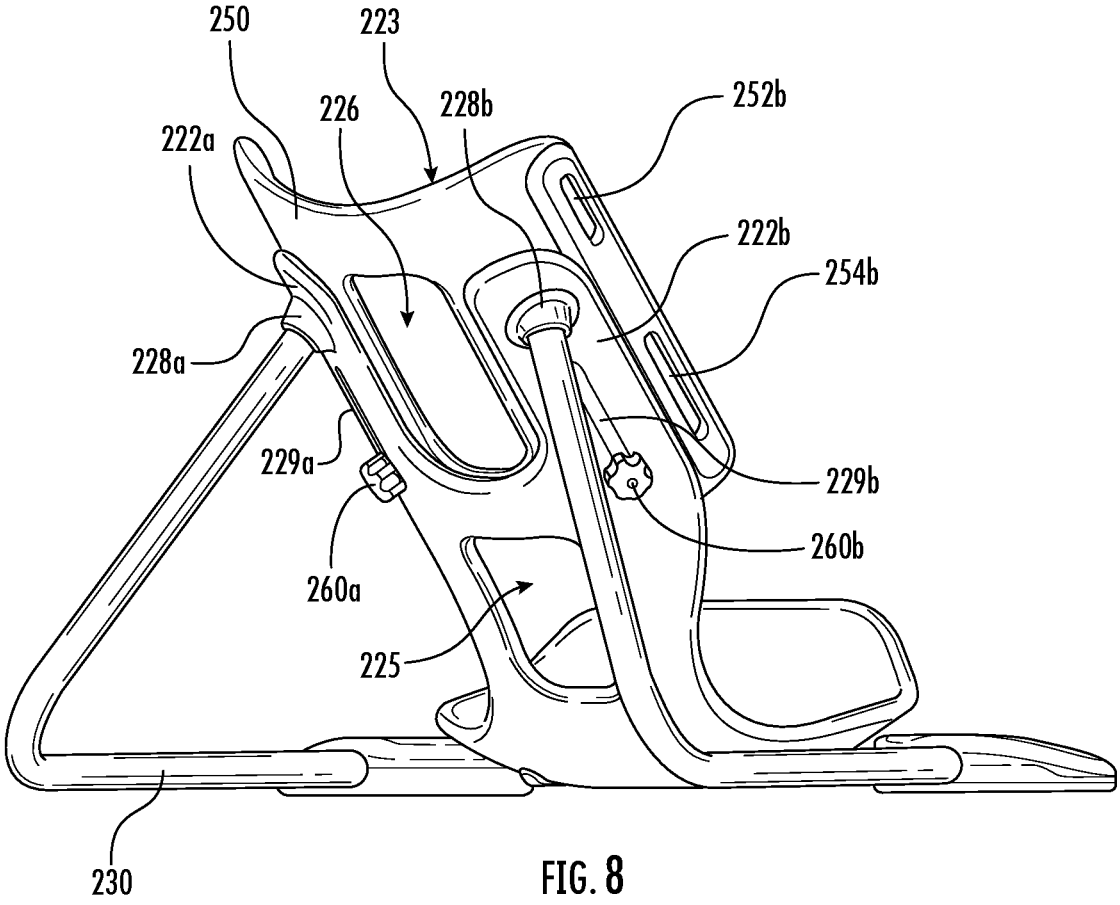
FIG. 8 is a rear perspective view of the second embodiment of the infant stabilizer according to FIG. 6 with various components removed for illustration purposes.
Figure 9:
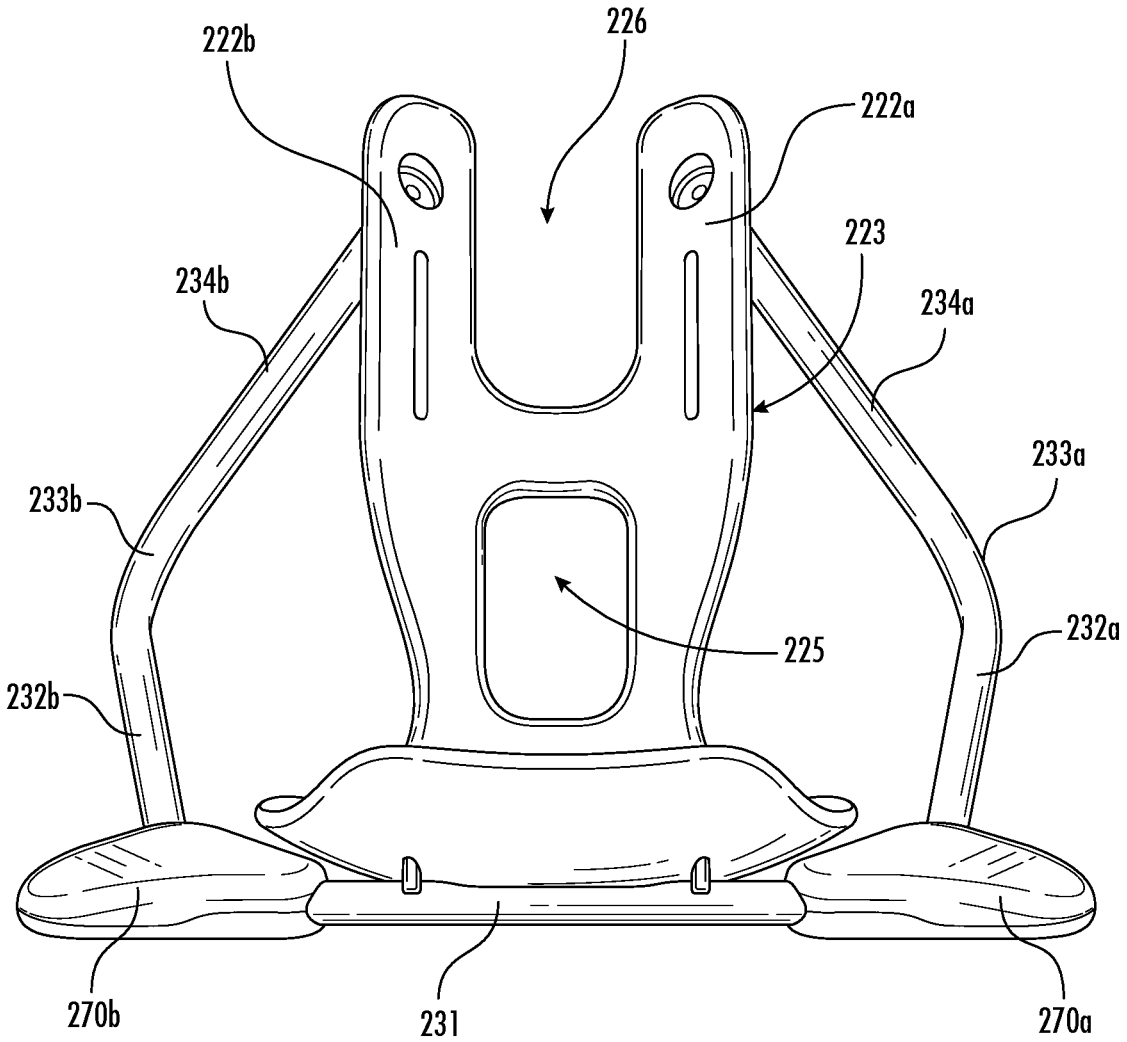
FIG. 9 is a front view of the infant stabilizer according to FIG. 6 with various components removed for illustration purposes.
Figure 10:
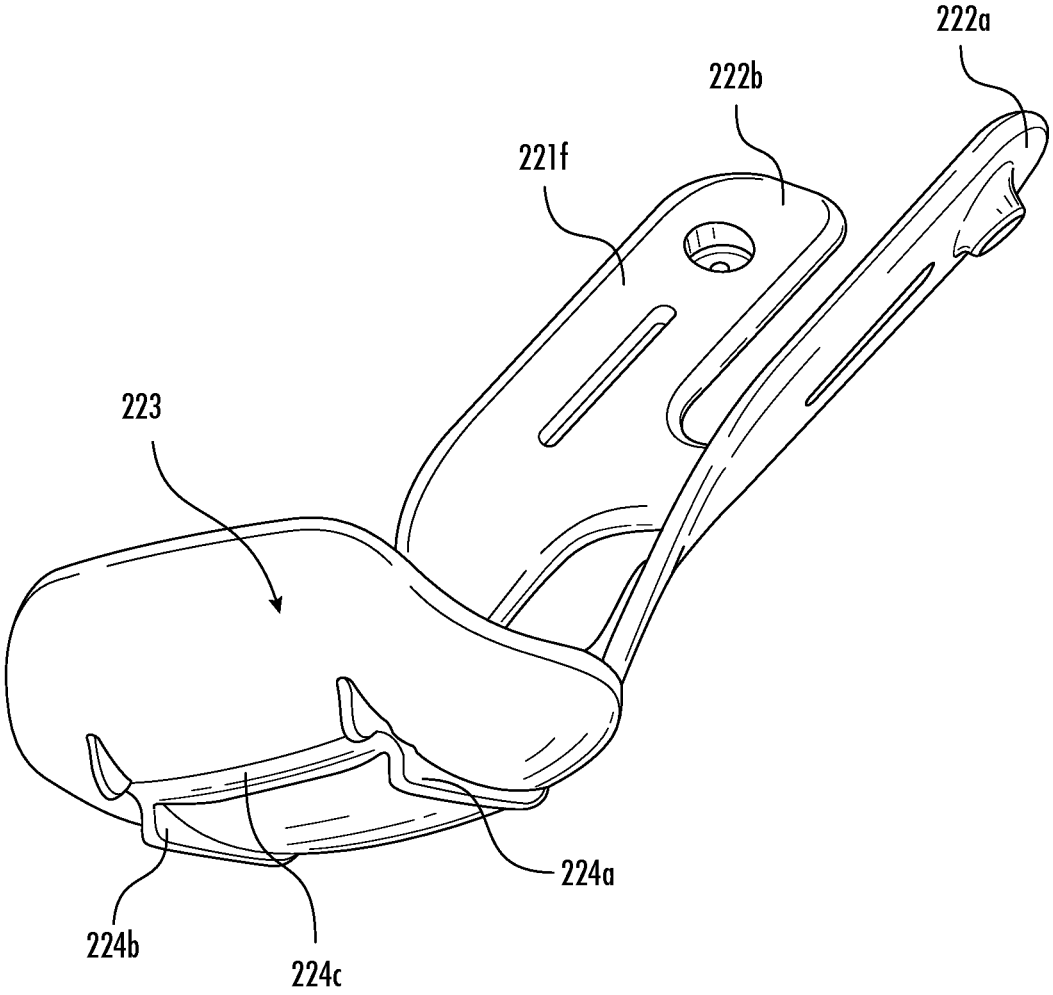
FIG. 10 is a bottom perspective view of the lower frame of the second embodiment of the infant stabilizer according to FIG. 6.

As best seen in FIG. 8, the upper U-shaped frame 221 can include a first and second uprights 222*a*, 222*b* that define a facial opening 226. The facial opening 226 can provide for a place for the infant's face to be located to provide a clear breathing airway. On a rear face of the first and second uprights 222*a*, 222*b* anchor points 228*a*, 228*b* for attachment stand 230 can be disposed and will be discussed in detail below with respect to the attachment stand 230. The first and second uprights 222*a*, 222*b* can additionally include respective grooves 229*a*, 229*b*, below the respective anchor point 228*a*, 228*b*. The respective grooves 229*a*, 229*b* that are obround, or stadium, in shape and can be sized to slidably receive a compression screw and knob 260*a*, 260*b* extending therethrough to slidably secure the slide frame 250. The length of the grooves 229*a*, 229*b* define the amount of vertical adjustment the slide frame 250 can move relative to the frame 222. The compression screws 260*a*, 260*b* can be received in a respective threaded through hole 262*a*, 262*b* on the rear of the slide frame 250, as shown in FIG. 11.

Figure 6:
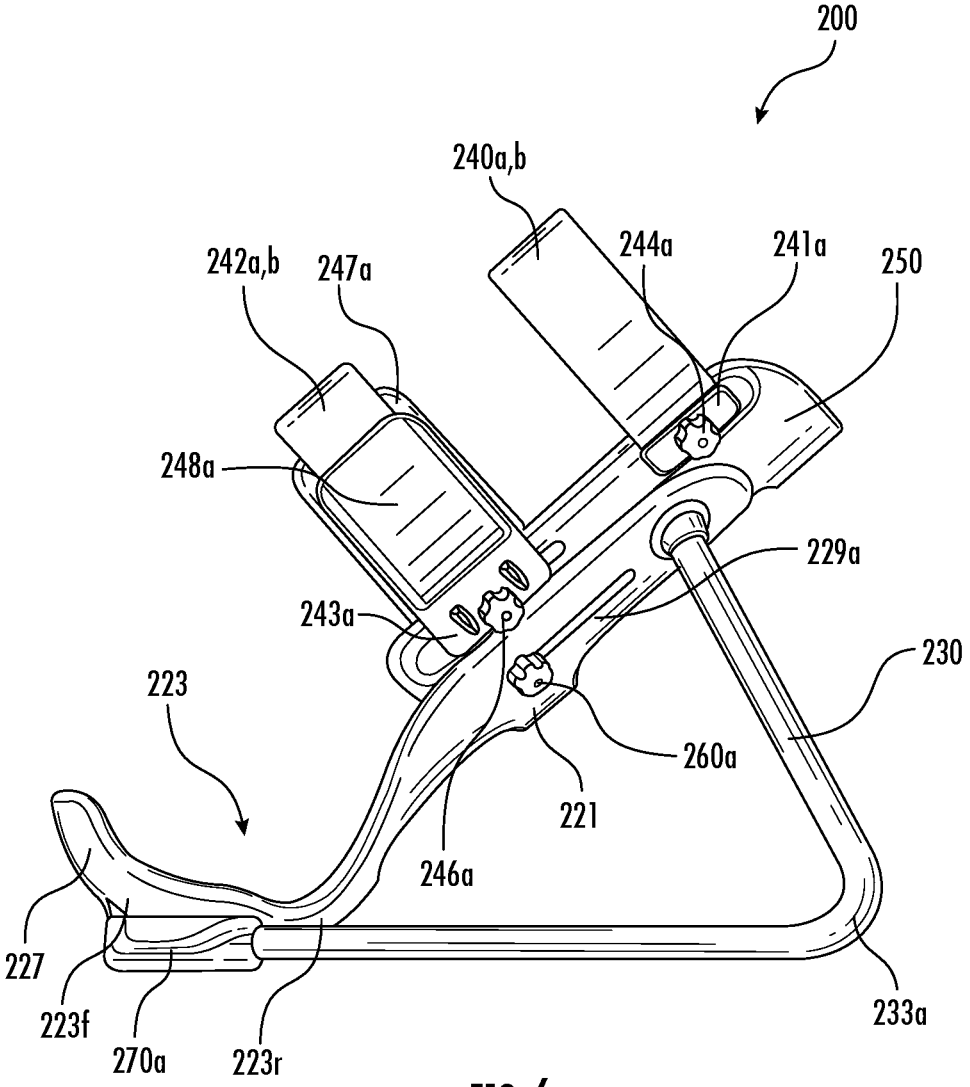
FIG. 6 is a side view of an infant stabilizer according to a second embodiment of the present invention.
Figure 7:
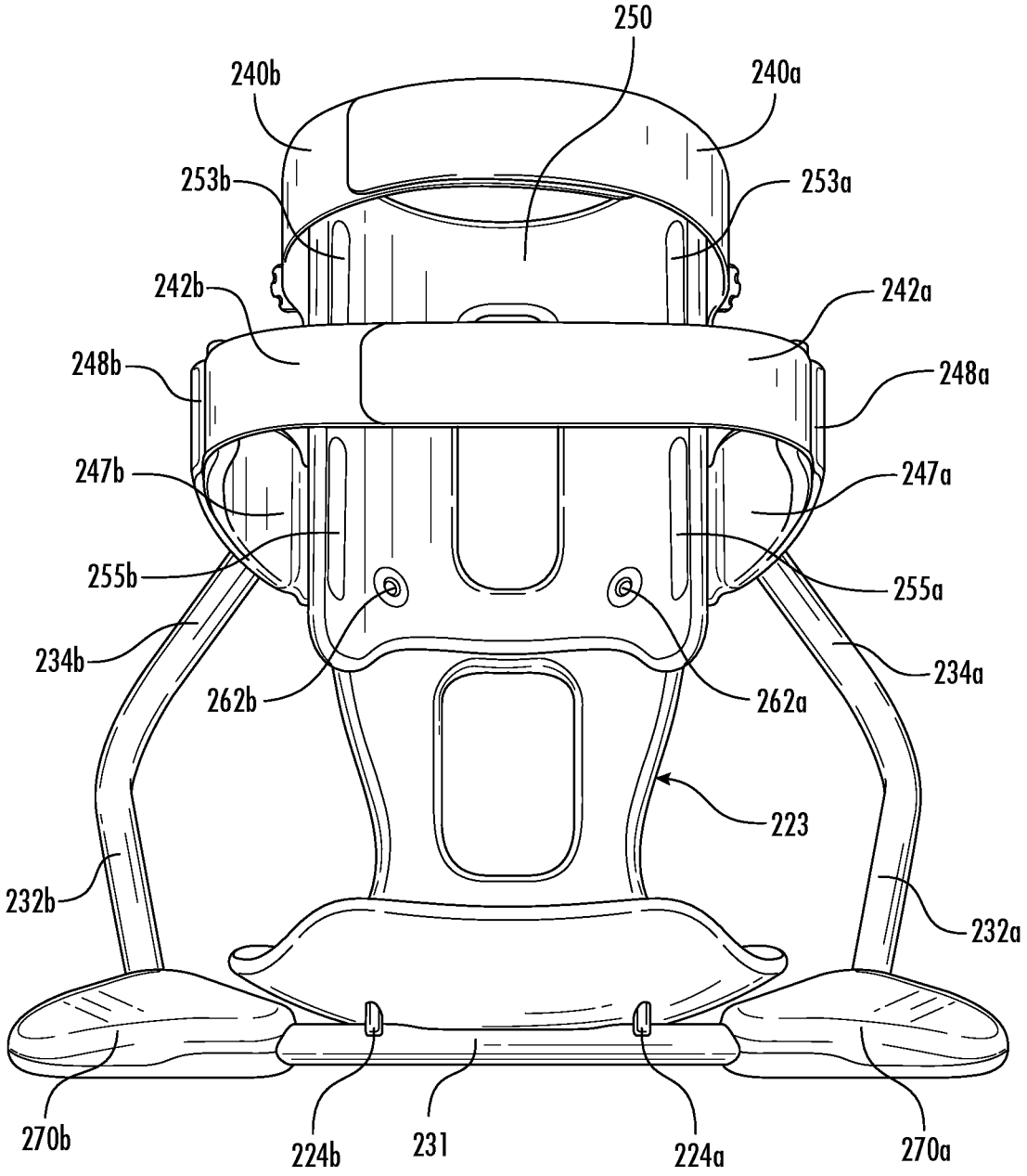
FIG. 7 is a front view of the second embodiment of the infant stabilizer according to FIG. 6.

As illustrated in FIGS. 6 and 7, the slide frame 250 is designed to be vertically adjustable relative to the frame 220 to accommodate children of a variety of sizes. Advantageously, with an adjustable stabilizer device 200, precious storage room can be saved as a plurality of sized stabilizers in a plurality of sizes are not required. In addition, or alternative, to the slide frame 250 being vertically adjustable, the two sets of straps 240*a*, 240*b*, 242*a*, 242*b* can be vertically adjustable relative to the slide frame 250 and the other of the straps. Thus, due to the adjustability of the slide frame 250 and the straps 240*a*, 240*b*, 242*a*, 242*b*, the overall device 200 can accommodate infants of various sizes, body shapes, and other medical considerations (e.g. a problematically placed port or sensors).

Figure 11:
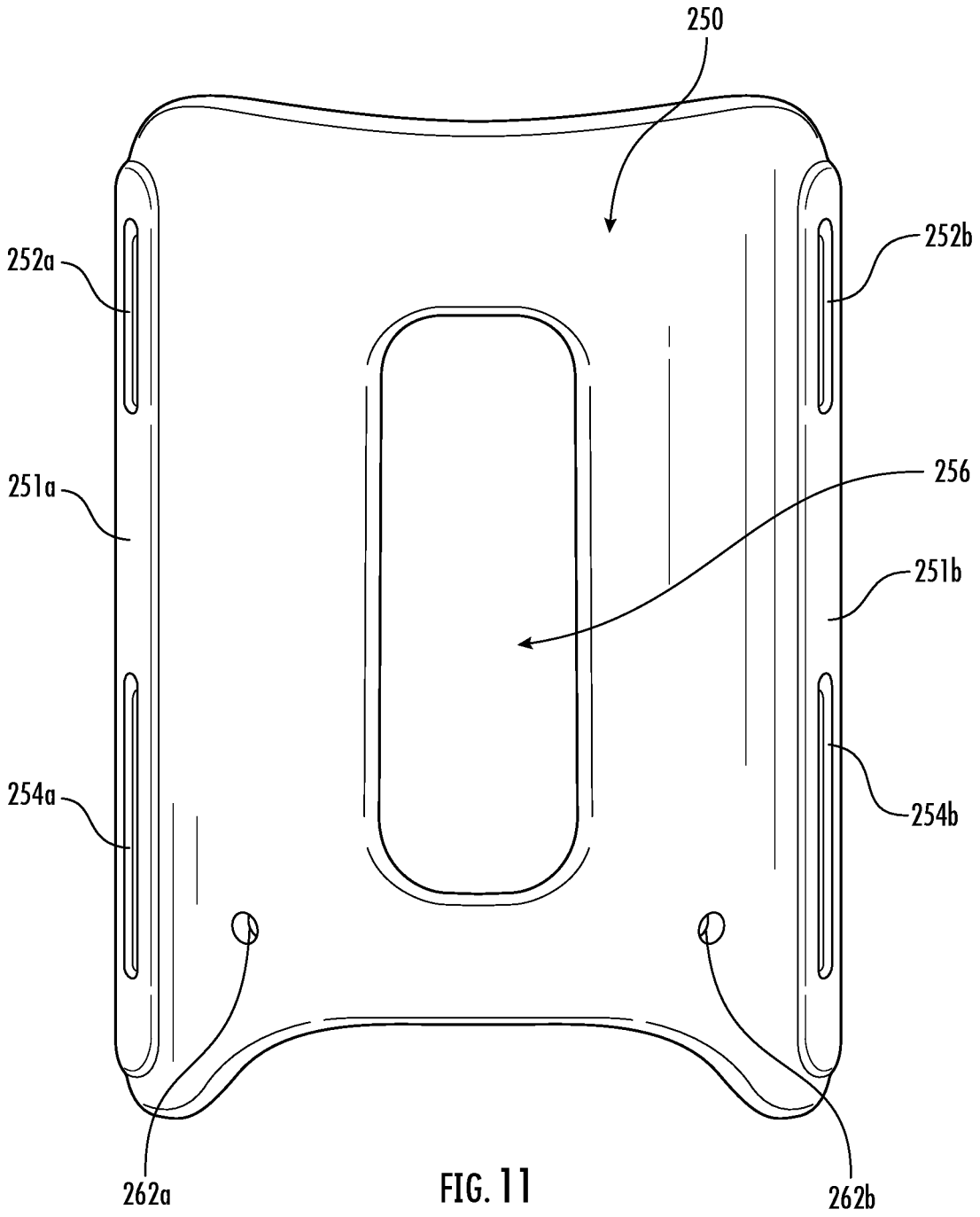
FIG. 11 is a rear view of the slide frame of the second embodiment of infant stabilizer according to FIG. 6.

As seen in FIG. 11, the slide frame 250 can be of a rectangular shape with rounded corners having a corresponding U-Shape in cross section to match the upper portion 221 of the frame 220. The slide frame 250 is designed to sit and ride on the front face 221*f* of the upper frame portion 221 and is retained to the upper frame by the compression screws with knobs 260*a*, 260*b* being received in respective threaded through holes 262*a*, 262*b*. The compression screws 260*a*, 260*b* can be inserted from the rear of the upper frame 212 through respective slots 229*a,b* into the threaded through holes 262*a*, 262*b* of the slide frame 250. Once the desired height is reached the knobs 260*a*, 260*b* can be turned to tighten and thus fix the slide frame 250 relative to the upper frame 212. Similar to the upper frame 212, the slide frame 250 can include a facial opening 256 to permit easy breathing for the infant.

Referring back to FIGS. 6 and 7, in order to retain the infant in the device 200, two sets of straps 240*a*, 240*b*, 242*a*, 242*b*, or more, can be provided to secure the infants head and the infants torso. In some embodiments, as shown in FIGS. 1-5, the straps can be fixed relative the frame 220. In the illustrated embodiment of FIGS. 6-11, an upper set of slots 252*a*, 252*b* and a lower set of slots 254*a*, 254*b* on the left and right edges 251*a*, 251*b* of the slide frame 250 are provided to allow the straps 240*a*, 240*b*, 242*a*, 242*b* to be vertically adjusted for the proper height of the child. The upper left and right straps 240*a*, 240*b* can each have a distal end with a retaining plate 241*a*, (only one side is shown) having a through hole (not shown) to receive a compression screw 244*a*. The upper compression screws 244*a* can be inserted from the rear of the slide frame 250 into the respective retaining plate 241*a* and slid up or down within the respective slot 252*a*, 252*b*. While only one side of the compression screws 244*a* and plates 241*a* are shown, one of ordinary skill in the art will understand that the opposite strap has the same structure. When the respective compression screws 244*a* are tightened, they can fix the respective plate 241*a* and thus the strap 240*a*, 240*b* at a given height. The compression fit fixes the plate 241*a* and thus the strap 240*a*, 240*b* at the chosen height. In the illustrated embodiment, a respective plate 241*a* can be located on the back of the slide frame 250 and a respective cap 253*a*, 253*b* can be inserted from the front to cover the compression screw 244*a* to prevent any injury to the infant. In some embodiments, as illustrated, the straps 240*a*, 240*b* can be cushioned on a rear face to provide comfort to the child and can be fastened to one another via hook and loop fasteners, or similar mechanical or magnetic fasteners (not shown).

The lower straps 242*a*, 242*b* can be substantially the same as the upper straps with the inclusion of included cushion pads 247*a*, 247*b* to cushion around the infant's torso and outer plates 248*a* that are larger to retain the straps shape around the torso when loading the infant into the device. The lower left and right straps 242*a*, 242*b* can each have a distal end with a retaining plate 243*a* (only one is shown) having a through hole (not shown) to receive a compression screw 246*a* (only one is shown). The respective lower compression screws 246*a* can be inserted from the rear of the slide frame 250 into the respective retaining plate 243*a* and slid up or down within the respective slot 254*a*, 254*b*. When the respective compression screws 246*a* are tightened, they can fix the respective lower plate 243*a* and thus the lower straps 242*a*, 242*b* at a given height. The compression fit fixes the plate 243*a* and thus the strap 242*a*, 242*b* at the chosen height. In the illustrated embodiment, a respective plate 243*a* can be located on the back of the slide frame 250 and a respective cap 255*a*, 255*b* can be inserted from the front to cover the compression screw 246*a* to prevent any injury to the infant. In some embodiments, the straps 242*a*, 242*b* can be fastened to one another via hook and loop fasteners, or similar mechanical or magnetic fasteners (not shown).

In some embodiments, the attachment stand 230 can be substantially the same as the attachment stand above. Alternatively, as shown in the illustrated embodiment, the attachment stand 230 can be a modified "U" shaped stand with two plastic support feet 270*a*, 270*b*. The modified "U" shaped frame can include a central base portion 231 having two legs 232*a*, 232*b* extending rearwardly and outward (relative to a line that extends perpendicular to the central base portion). Each of the legs includes upright supports 234*a*, 234*b* that extend forward and inward towards a distal end. The attachment stand 230 can be formed with a cylindrical cross section and the distal ends can be received in anchor holes on the upper frame. At the bend point 233*a*, 233*b* from the central base portion to the two respective legs 232*a*, 232*b*, the assembly can include plastic support feet 270 that include an internal channel for receiving the stand. The support feet 270 can provide for added stabilization, thought they are not required. Additionally, or alternatively, the lower portion 223 of the frame can include two offset projections 224*a*, 224*b* and a channel 224*c* extending therebetween to capture a portion of the central base portion 231 where the lower portion 223 rests thereon.

In use, as in FIGS. 6 and 7, an infant can be placed in the device 200 before or after the adjustment of the device. The knobs 260*a*, 260*b* for the slide frame 250 can be loosened, but not removed, to allow the slide frame 250 to be adjusted up or down, as needed, relative to the frame 200. Once the slide frame 250 is in the appropriate location the knobs 260*a*, 260*b* can be turned in the opposite direction to lock the slide frame 250 in place. Similarly, one or both sets of straps 240*a*, 240*b*, 242*a*, 242*b*, or just one strap, can be adjusted by rotating the respective knob clockwise, or counterclockwise, to loosen the connection and allow for sliding movement through the respective slots up or down. Again, once the desired location in the slot is achieved, the respective knob can be tightened to secure the location of the strap 240*a*, 240*b*, 242*a*, 242*b* relative to the slide frame 250 and the frame 220. Once the adjustments are complete, a user can place the infant, face first, into the device 200. The user will ensure that the infant's face is disposed in the openings 226, 256 and the abdomen is disposed in the abdomen opening 225, all to ensure that the infant's ability to breath is not hindered. The user can then use the upper straps 240*a*, 240*b* to retain the infant's head and the lower straps 242*a*, 242*b* to retain the infant's torso. Once secured to the device 200, the medical procedure can begin with the infant being held still during the lumbar puncture, for example, to eliminate human error and to optimize the success of the procedure. Advantageously, the instant devices 100, 200 can improve the rates of non-traumatic lumber punctures while maintaining the infant's ability to breath comfortably—thus maintaining the infant in a secure upright position which has been shown to be better positioning for maximal width of spinal fluid column. These advantages during the procedure can lead to lower costs and shorter hospital stays.

It would be appreciated by those skilled in the art that various changes and modifications can be made to the illustrated embodiments without departing from the spirit of the present invention. All such modifications and changes are intended to be covered by the appended claims.

What is claimed is:

1. An infant positioning device for stabilizing and maintaining an infant in a fixed position during a medical procedure, comprising:

a frame for positioning the infant in a desired position, the frame including at least one opening configured to aid the infant with breathing; the frame further including a left side and a right side;

a left outer plate having a first end connected to the left side of the frame and a second free end;

a right outer plate having a first end connected to the right side of the frame and a second free end;

a first strap connected to the second end of the left outer plate and the second end of the right outer plate; the first adjustable strap being configured and arranged to accommodate and releasably secure a torso region of an infant against the frame;

a second strap having a first end and a second end; the first end connected directly to the left side of the frame and the second end connected directly to the right side of the frame; the second strap being configured and arranged to accommodate and releasably secure a head of an infant against the frame.

2. The infant positioning device of claim 1, wherein the frame includes a plurality of openings, including a facial opening for the infant's face and an abdomen opening for the infant's abdomen to allow for ease-of-breathing.

3. The infant positioning device of claim 1, wherein the stand has a U-shape and is connected to the frame to allow the frame to be self-standing and to be oriented at an angle appropriate to the medical procedure being performed.

4. The infant positioning device of claim 1, wherein the first strap includes a first strap portion and a second strap portion releasably connected to each other by, mechanical fasteners configured to retain the first and second straps together to provide an adjustable first strap.

5. The infant positioning device of claim 1, further comprising:

padding on the first strap facing the frame.

6. The infant positioning device of claim 1, wherein the left outer plate and the right outer plate are vertically adjustable along the frame.

7. The infant positioning device of claim 1, further comprising padding on the second strap facing the frame.

8. The infant positioning device of claim 1, wherein the first end of the strap is vertically adjustable along the length of the left side of the frame and the second end of the second strap is vertically adjustable along the length of the right side of the frame.

9. The infant positioning device of claim 1, wherein the frame includes a static frame which the stand is connected to and a slide frame that is configured and arranged to slide on the static frame.

10. The infant positioning device of claim 9, further comprising:

a first slot and a second slot extending through the static frame;

a first compression screw extending through the first slot and into a first threaded hole in the slide frame; and a second compression screw extending through the second slot and into a second threaded hole in the slide frame; and wherein the first and second compression screws can be rotated in a first direction to allow the slide frame to move relative to the static frame, and the first and second compression screws can be rotated in a second direction, opposite to the first direction, to fix the slide frame relative to the static frame.

11. The infant positioning device of claim 9, wherein the first strap and the second strap are connected to the slide frame.

12. The infant positioning device of claim 11, wherein the first strap and the second strap are vertically adjustable along the slide frame.

13. A method of positioning an infant to stabilized and maintain an infant during a medical procedure, comprising the steps of:

positioning a frame including a plurality of openings and a left side and a right side;

placing the infant face first into the frame such that the plurality of openings in the frame are aligned with the infant's face, chest, and abdomen;

providing a left outer plate having a first end connected to the left side of the frame and a second free end;

providing a right outer plate having a first end connected to the right side of the frame and a second free end;

providing a first strap;

providing a second strap;

stabilizing a chest of an infant with the first strap connected between the second free end of the left outer plate and the second free end of the right outer plate;

stabilizing a head of an infant with the second strap connected between the left side of the frame and the right side of the frame;

orienting an infant, using the frame component to achieve the desired angle to the ground for a medical procedure.

14. The method of claim 13, further comprising the step of:

adjusting a size of the frame to orient the infant's face, chest, and abdomen are aligned with the plurality of openings.

15. The method of claim 14, further comprising the step of:

adjusting a relative location of the first strap and the second strap relative to the frame.

16. The method of claim 13, wherein the medical procedure is a lumbar puncture.

* * * * *